United States Patent [19]

Kelly, Jr.

[11] 3,939,091

[45] Feb. 17, 1976

[54] COMPOSITION FOR USE IN DEACIDIFICATION OF PAPER

[75] Inventor: George B. Kelly, Jr., Gaithersburg, Md.

[73] Assignee: The United States of America as represented by the Librarian of Congress, Washington, D.C.

[22] Filed: Feb. 14, 1975

[21] Appl. No.: 550,087

[52] U.S. Cl. ..... 252/189; 21/58; 427/421; 427/439; 252/305; 252/382

[51] Int. Cl.[2] ..... C09K 3/30; A61L 13/00

[58] Field of Search ..... 252/189, 305, 382–384; 427/421, 439, 343, ; 21/58; 162/72, 76, 158, 160

[56] References Cited

UNITED STATES PATENTS

| | | | |
|---|---|---|---|
| 2,073,398 | 3/1937 | Chesny | 252/189 X |
| 3,536,578 | 10/1970 | Brundige et al. | 162/160 |
| 3,557,011 | 1/1971 | Colombo et al. | 252/189 |
| 3,619,355 | 11/1971 | Silberman | 252/383 |
| 3,676,055 | 7/1972 | Smith | 8/120 |
| 3,676,182 | 7/1972 | Smith | 427/439 X |

OTHER PUBLICATIONS

Stiles et al., J. Am. Chem. Soc., 81, 505–506, (1959).

Williams, A.B.I.P.C., 43, No. 3, 291–292, Abs. No. 2926 (1972).

Smith et al., A.B.I.P.C., 41, No. 3, 222, Abs. No. 2199 (1970).

Smith, A.B.I.P.C., 41, No. 10, 918, Abs. No. 9501, (1971).

*Primary Examiner*—Edward A. Miller

*Attorney, Agent, or Firm*—Joseph A. Hill; A. David Spevack; Paul F. Arseneau

[57] ABSTRACT

A composition for use in Deacidification of Paper, which comprises 0.1 to 20% by weight of methyl magnesium carbonate in an organic solvent, where the solvent is not harmful to the paper.

6 Claims, No Drawings

COMPOSITION FOR USE IN DEACIDIFICATION OF PAPER

Government License

The invention described herein may be manufactured and used by or for the Government of the United States of America for Governmental purposes without the payment of any royalties thereon or therefore.

Barrow and others developed aqueous solutions for deacidification of books and papers, but the disadvantages of these aqueous methods for many conservation needs have led to a diligent search for practical and economical non-aqueous methods for such treatment.

Baynes-Cope (1) proposed the use of about a one percent solution of barium hydroxide in methanol for the non-aqueous deacidification of paper. This is effective in neutralizing acid and in conferring substantial alkaline reserve in treated papers, but suffers from the fact that barium compounds are very toxic, and that barium hydroxide is a very strong alkali. Although the barium hydroxide is slowly converted to barium carbonate, a very insoluble and relatively mild alkali, by reaction with carbon dioxide of the air, the paper is exposed to the high alkalinity for a significant length of time. It is well known that cellulose becomes extremely sensitive to oxidation at high alkalinity. These disadvantages severely limit the use of this method.

The Regnal process for non-aqueous deacidification uses magnesium acetate dissolved or suspended in polyvinyl acetal in organic solvents. These solutions are used to impregnate the paper with the polyvinyl acetal and magnesium acetate. The polyvinyl acetal reinforces weak papers and the magnesium acetate acts as a buffer, neutralizing strong acids and releasing the relatively weak acetic acid which is then lost by evaporation. This process does strengthen weak paper, but provides little protection against acid deterioration. First, the magnesium acetate is not very soluble in organic solvents which severely limits the amount that can be introduced into the paper, and second, the acetic acid released is sufficiently acid to damage paper, although it does so at a slower rate than stronger acids such as sulfuric or hydrochloric. Thus the Regnal process is not completely effective in stabilizing the paper against acid deterioration.

R. D. Smith in U.S. Pat. No. 3,676,055 issued July 11, 1972 has taught the use of magnesium methoxide (sometimes called magnesium methylate [$(CH_3O)_2Mg$]) for the non-aqueous deacidification of books and papers. Magnesium methoxide is soluble in methanol up to about 8 or 9 percent concentration. Smith recommends that the solution be diluted to about 1.0 or 1.5 percent concentration preferably with a halogenated hydrocarbon. Books and papers may be dipped in the solution or the solution may be applied by brushing or spraying. Smith also suggests that a pressure spray container with the self-generating pressure spray from the use of a low boiling halogenated hydrocarbon such as difluorodichloromethane or one of the other low-boiling fluorocarbons makes a convenient method of applying the solution. The halogenated hydrocarbons contribute to rapid evaporation of the solution and tend to minimize attack on certain inks by the methanol.

When the solvent solution is applied to paper, it hydrolyzes promptly to form magnesium hydroxide, a moderately strong alkali, which is then slowly converted to magnesium carbonate by exposure to atmospheric carbon dioxide. This carbonation process may be speeded up by exposing the treated book or paper to an atmosphere of carbon dioxide for a period of time, but this represents an additional step and extra time in treating the paper or book. Furthermore, the paper is exposed to the strong alkali magnesium hydroxide during the time that carbonation is occurring, thus subjecting the paper to the danger of increased oxidation from the strongly alkaline conditions.

The most serious objections to Smith's method, however, revolve around the practical application of the solution to books and papers. Magnesium methoxide is extraordinarily sensitive to water and must be kept in carefully sealed containers, since even traces of moisture cause immediate hydrolysis of the magnesium methoxide and precipitation of magnesium hydroxide, a white, gelatinous, material that is insoluble in water as well as inorganic solvents. Thus, pans of magnesium methylate solution exposed to the atmosphere for dipping books are quickly exhausted by hydrolysis from the water vapor in the air. When the solution is sprayed on books, as suggested by Smith, spray nozzles are subject to frequent plugging, requiring disassembly, cleaning with acid, and careful re-drying before reassembly. This is a tedious, annoying, and expensive procedure when a number of books are to be treated. The use of brushes to apply the solution is no better, as the bristles quickly become clogged with magnesium hydroxide, and must be cleaned in acid and dried before reuse.

Furthermore, the paper must be dried considerably below the normal equilibrium moisture content of 5 to 6 percent to prevent premature hydrolysis of the magnesium solution on the surface of the paper, causing a glaze of magnesium hydroxide which obscures the writing or printing, and limits the penetration of the solution to the interior of the sheet of paper which, as a result, may be incompletely deacidified.

Problems with Smith's magnesium methoxide process become so severe on damp days that it is virtually inoperable on a production basis.

DESCRIPTION OF THE INVENTION

In contrast to the difficulties described with the prior art of non-aqueous deacidification, I have found that these difficulties can be eliminated by the use of methyl magnesium carbonate in organic solvent. Methanol is suitable as a solvent, as are mixtures of methanol with other organic solvents such as butane, hexane, octane, benzene, toluene, halogenated hydrocarbons, ethers, esters, ketones and the like. The only consideration is that the solvent be reasonably volatile in order that treated books and papers dry readily, and that the solvent be compatible with the methyl magnesium carbonate. It is also desirable that the solvent not discolor or be otherwise detrimental to the papers or books being treated. A suitable choice of solvent will be readily apparent to one skilled in the art.

Methyl magnesium carbonate was prepared by Szarvasy in 1897 (Berichte, 30, 1836 (1897).), giving its formula as

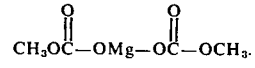

Stiles and Finkbeiner [Am. Soc., 81, 505-506, (1959)] later showed this to be incorrect, and indicated that the formula should be $CH_3OMgOCO_2CH_3.XCO_2$ where X varies with the solvent and temperature. Detailed procedures were given for its preparation. We have found the following simplified procedure preferable for preparing a solution to be used in the deacidification and buffering of books and papers.

Magnesium methoxide is prepared by known procedures to give an 8 percent solution in methanol by weight. If desired even higher concentrations can be prepared, but the excess above 8 or 9 percent will not dissolve in the methanol, and remains as a precipitate, forming a slurry with the solution. Carbon dioxide is then passed into the solution or suspension until it is saturated with the carbon dioxide. This usually requires about an hour with a moderate flow of carbon dioxide and good mixing. In the case of the 8 percent solution of magnesium methoxide, the initial reaction with the carbon dioxide produces a turbidity or precipitate within a short time, but this redissolves on continued addition of carbon dioxide and the solution becomes clear and colorless if pure reagents are used — otherwise a mild yellow color may develop. This color does not appear to be harmful, as it generally disappears when the paper is treated and dried. However, it is best to test any discolored solution on paper of no value before use on valuable books and papers, and to repeat the preparation of the solution with reagents of higher purity if permanent stains are noted. Normally, magnesium metal suitable for Grignard reagent preparation, synthetic absolute methanol of electronic grade or ACS grade, and the ordinary commercial grade (99.5%+) of carbon dioxide are satisfactory for producing colorless methyl magnesium carbonate solutions.

The stock solution described may be concentrated to 20 percent or higher for shipment or storage by distilling off excess methanol. If desired, all of the methanol can be distilled off leaving a solid material which can be stored in tightly closed containers and redissolved in methanol as desired for use. (Magnesium methoxide becomes very feebly soluble once the methanol is removed and it cannot be redissolved to form solutions more concentrated than about 1 percent, even in boiling methanol. This is a further advantage of the methyl magnesium carbonate.) The magnesium methyl carbonate dissolves faster if the methanol contains dissolved carbon dioxide, but this is not necessary.

For use, the stock solution preferably is diluted to a concentration of about 1 to 3 percent using methanol or one of the other solvents enumerated above. It is nearly always desirable that the treated book or paper contain about 2 to 3 percent of magnesium carbonate after the treatment. This will provide an alkaline reserve sufficient to protect the book from acid for many years, typically 300 to 500 years or more. Greater or lesser concentrations are possible, however, depending upon the estimate of risk to acid exposure of the treated book or paper. Acid exposures are usually derived from polluted atmospheres, particularly in heavy industrial environments, so books and papers thus exposed would require more alkaline reserve than a book or paper exposed only to a remote rural environment. However even in rural environments the book will be subjected to some atmospheric contaminants and to internally generated acids from oxidation, or hydrolysis of additives.

The advantages of the methyl magnesium carbonate solution are most evident in the process of treating books and papers by dipping, spraying, or brushing. These solutions are very tolerant of water compared to solutions of magnesuim methoxide, and do not cause plugging of spray nozzles. Simple rinsing in methanol is sufficient to keep bristle brushes clean and flexible. There is no tendency for pans of the solution to precipitate when dipping books and papers, even when exposed to damp atmospheres for several hours. Covering the pans tightly between dips, or maintaining a carbon dioxide atmosphere over the surface of the solution is sufficient to prolong the usefulness of the solution without precipitation for several days. Considering the volatility of the solvent, it is unlikely that greater stability during use would be of any practical significance, as evaporation, and exhaustion of the solution by the treated papers would change the concentration to the point where replacement would be desirable.

The tolerance of methyl magnesium carbonate to water is best illustrated by an experiment comparing it to magnesium methoxide. A 1.5 percent solution by weight of methyl magnesium carbonate and a 1.5 percent solution by weight of magnesium methoxide were made up in methanol. Both solutions were clear and colorless. Then 5 ml of a 10 percent by weight solution of water in methanol was added to 140 ml portions of each of the two solutions. The solution of methyl magnesium carbonate remained clear and colorless. The solution of magnesium hydroxide on the other hand immediately became turbid and was filled with a copious white, gelatinous precipitate of magnesium hydroxide. Even a second addition of 5 ml of 10 percent water in methanol caused no precipitation to the methyl magnesium carbonate. Thus it can be seen that the methyl magnesium carbonate is extremely tolerant of water, explaining its remarkable freedom from plugging when used in spray equipment.

When the methyl magnesium carbonate solution is applied to paper and dried, the material slowly hydrolyzes to form magnesium carbonate without going through the magnesium hydroxide, and thus does not expose the paper to such highly alkaline conditions as does magnesium methylate.

The operating limits of my invention are from about 0.1 percent to 20 percent or more by weight of methyl magnesium carbonate in methanol, or a mixture of methanol and other organic solvents as enumerated previously. The preferred limits are from about 1 percent to 3 percent by weight in solution. The actual concentration used is determined more by the amount of alkaline reserve to be left in the paper than by the requirements for deacidification, since even very low concentrations of a few tenths of a percent of methyl magnesium carbonate are usually adequate to deacidify most acid papers when they are thoroughly wet with the solution. With more concentrated solutions, it is possible to completely deacidify books and papers with a light spray that barely dampens the paper, an advantage when treating books, as the book then dries so rapidly that the pages can be treated and dried almost as fast as the pages can be turned. Danger of solvent damage to sensitive inks is thereby minimized. Operation with concentrated soltuions, 3 percent to 10 percent by weight is feasible with methyl magnesium carbonate to give higher alkaline reserves if desired, giving great flexibility to operating with my invention. This is not possible with magnesium methoxide because the difficulties described will be intensified with higher concentrations. The operation of my invention is demonstrated by the following examples.

EXAMPLE 1

A solution of magnesium methoxide was prepared by dissolving magnesium metal turnings in anhydrous methyl alcohol to form a solution of 3 percent wt/volume.

A second solution was prepared by taking a portion of the magnesium methoxide solution and saturating it with carbon dioxide by bubbling a slow stream of the gas through the solution for 3 hours while maintaining good agitation.

Both solutions were clear and colorless.

A portion of the second solution was evaporated to dryness under vacuum, yielding a white, glassy solid which was easily pulverized to a white powder. This powder analysed 16.65 percent magnesium and 40.82 percent carbon dioxide which is consistent with the formula.

$CH_3OMgOCO_2CH_3$: 0.355 $CO_2$-methyl magnesium carbonate

The solid redissolved readily in methanol saturated with carbon dioxide, but dissolved very slowly in plain methanol.

The magnesium methoxide solution (solution no. 1) and the methyl magnesium carbonate (solution no. 2) were used to treat acid papers by applying both solutions with a paint sprayer ("Tuffy" model NCF501 with Type EGA502 spray gun manufactured by the DeVilbiss Co., Toledo, OH). With solution no. 1, the spray head plugged in less than 10 minutes of intermittent spraying as the papers were sprayed, set aside to dry and more papers laid out for spraying. In contrast to this behavior, solution no. 2 was used for the entire day (about 7 hours) with absolutely no difficulty experienced from plugging. Rinsing the spray gun with methanol at the end of the day was sufficient to clean the gun so that no visible residues remained.

On damp days (RH above 50 percent), papers sprayed with solution No. 1 acquired a glaze of magnesium hydroxide on the surface which partially obscured the writing or printing and left a powdery white deposit on drying. This deposit was difficult to remove completely, but tended to dust off slowly with handling. The treated papers were unpleasant and harsh to the touch.

In contrast to this, the papers sprayed with solution no. 2 were soft and smooth to the touch, and there was not obscuration of the writing or printing even when the papers were slightly damp (8–10 percent moisture present) when they were sprayed. There was no powdery deposit after drying, and the papers were smooth and pleasant to the touch.

EXAMPLE 2

A solution of 1 percent magnesium methoxide was made up by diluting a commercial solution of 8 percent magmesium methoxide in methanol with Freon TF (Trichlorotrifluoroethane) to 1 percent concentration (w/v).

This solution was used to treat the papers listed in Table 1 as follows: Twenty-five ml of the solution was poured into a shallow tray slightly larger than the 8½× 11 inch sheets of paper to be treated, and a single sheet of paper was immersed in the solution. The paper was thoroughly impregnated by rocking the tray to agitate the solution and insure even distribution. After three minutes, the paper was removed from the solution, drained and hung up to dry, blotting off any excess liquid accumulating at the lower edge.

The excess of the 25 ml of solution was discarded and the pan wiped carefully to remove any residues. A fresh 25 ml of solution was used for the next sheet of paper. In this way each sheet was treated exactly alike and there was no possibility of depletion of the solution from sample to sample.

The treated sheets were conditioned at 23°C and 50 percent RH for 24 hours and then tested with the results shown in Table II.

The testing procedures used were as follows:

pH — 2.5 grams of paper pulped 250 ml of water in in a Waring blender and the pH read on a pH meter with a glass electrode Acidity — The above pulp was titrated with 0.1N NaOH to a pH of 7.0 and the acidity calculated as milliequivalents per kilogram %$MgCO_3$ — The pulped sample was treated with excess standard hydrochloric acid, boiled to expel $CO_2$ and back titrated with 0.1N sodium hydroxide to a pH of 7.0. The amount of alkalinity present was calculated as %$MgCO_3$ M.I.T. Folding Endurance — TAPPI method T511, Su-69 Tensile Strength — TAPPI method T494, OS-70 Thickness — TAPPI method T411 OS-68 Brightness — TAPPI method T452 - M58 using a Photovolt model 670 meter Moisture Regain — TAPPI method T412-Su69

In dipping the papers in the solution, considerable difficulty was experienced because of the "glazing" of the surfaces of the paper with precipitated magnesium hydroxide. In fact, there was so much surface deposit that the thickness of the paper was significantly increased and there was much dusting of the paper during handling after drying.

TABLE I

Papers Used in Treatment Tests

| Paper | Name | Composition | pH | Additives |
|---|---|---|---|---|
| A | JCP-A60 | 30% Bleached Southern Kraft<br>70% Bleached Hardwood Kraft | 6.5 | 13 parts clay |
| B | Maderite Offset | 30% Bleached Southern Kraft<br>70% Hardwood Soda | 6.1 | 15 parts clay; rosin & starch |
| C | Handmade | 33% Refined Rag<br>33% Bleached Kraft<br>33% Sulfite | 5.3 | 1 percent Neuphor<br>3 percent alum |

These papers were conditioned at 23°C and 50 percent RH for 24 hours before treatment.

EXAMPLE 3

A portion of the 1 percent magnesium methoxide solution from Example 2 was converted to methyl magnesium carbonate solution by saturating the solution with carbon dioxide, bubbling a moderate stream of the gas through the solution for 1½ hours, at which point no more carbon dioxide would dissolve in the solution and conversion was complete.

Samples of the three papers were treated with this solution following the same procedure used in Example 2.

In dipping these papers, there was no precipitation from the solution, and no surface deposit. Thickness of the papers was essentially unchanged, and there was no dusting of the papers after drying.

Papers from Examples 2 and 3, together with the untreated controls, were conditioned for 24 hours at 23°C and 50 percent RH and then were tested with the results shown in Table II.

TABLE II

Comparison of Treated Papers with Untreated Controls

| Paper | pH | Acidity $Me_q$/Kg | $MgCO_3$, % | M.I.T. Fold, ½ Kg Load MD | M.I.T. Fold, ½ Kg Load CD | Tensile Strength, Kg/15 mm width MD | Tensile Strength, Kg/15 mm width CD | Thickness 1/1000" | Brightness | Moisture Regain % |
|---|---|---|---|---|---|---|---|---|---|---|
| JCP-A60 | | | | | | | | | | |
| Control-no treatment | 6.5 | 8 | — | 558 | 470 | 5.43 | 3.46 | 3.73 | 74.5 | 4.36 |
| Treated Ex. 2 | 9.1 | — | 7.35 | 532 | 549 | 5.51 | 3.50 | 4.40 | 74.6 | 2.74 |
| Treated Ex. 3 | 8.9 | — | 6.34 | 483 | 691 | 5.10 | 3.75 | 3.75 | 74.0 | 6.26 |
| Maderite Offset | | | | | | | | | | |
| Control-no treatment | 6.1 | 12 | — | 565 | 316 | 6.18 | 3.22 | 3.47 | 75.4 | 4.83 |
| Treated Ex. 2 | 10.2 | — | 6.85 | 670 | 449 | 6.83 | 3.17 | 4.00 | 75.4 | 2.80 |
| Treated Ex. 3 | 9.8 | — | 6.95 | 575 | 448 | 5.60 | 3.30 | 3.49 | 73.0 | 4.93 |
| Handmade | | | | | | | | | | |
| Control-no treatment | 5.3 | 40 | — | 8251 | — | 6.30 | — | 7.4 | 78.0 | 6.01 |
| Treated Ex. 2 | 10.3 | — | 9.24 | 5877 | — | 5.93 | — | 7.9 | 80.9 | 3.3 |
| Treated Ex. 3 | 10.3 | — | 10.25 | 5719 | — | 6.39 | — | 7.6 | 78.0 | 6.08 |

It was an unexpected benefit that the moisture regain of the papers treated with methyl magnesium carbonate were so much better than those treated with magnesium methoxide, as the better moisture regain indicates that the paper will have a higher equilibrium moisture content and therefore will be more flexible and less subject to embrittlement from drying out in atmospheres of low humidity after treatment. This also contributes to a more pleasant "feel" of the paper, as dry papers tend to feel harsh and unpleasant to the touch.

It can be seen from the test results that the treated papers were completely deacidified and that they contain significant alkaline reserves. The excessive surface deposits from the magnesium methoxide show up as an increase in the thickness of the paper not found with the methyl magnesium carbonate treatment. The excessive surface deposits caused an increase in the brightness with some of the papers treated with magnesium methoxide, but this would be undesirable for printed papers as the printing would tend to be obscured by such deposits.

Treatment with methyl magnesium carbonate is effective in prolonging the life of the paper as shown by the data in Table III which gives the results of accelerated aging tests on the paper. It is generally accepted that 3 days aging at 100°C is roughly equivalent to 25 years aging at normal room temperatures. The sheets of JCPA-60 papers treated with magnesium methoxide and with magnesium methyl carbonate were compared with untreated sheets after aging for 0, 3, 6, 12, and 36 days in an oven at 100°C. The deterioration of the paper is shown by the decline in folding endurance with age.

TABLE III

Accelerated Aging Tests at 100°C. Effect on M.I.T. Folding Endurance

| Paper | Days Aging - Fold Endurance 0 MD | 0 CD | 3 MD | 3 CD | 6 MD | 6 CD | 12 MD | 12 CD | 36 MD | 36 CD |
|---|---|---|---|---|---|---|---|---|---|---|
| JCP-A60 Untreated Control | 558 | 470 | 431 | 426 | 215 | 202 | 279 | 190 | 91 | 109 |
| JCP-A60 Treated EX. 2 | 532 | 549 | 409 | 371 | 364 | 253 | 384 | 288 | 246 | 354 |
| JCP-A60 Treated EX. 3 | 483 | 691 | 606 | 576 | 423 | 751 | 296 | 309 | 272 | 356 |

It is apparent that the treated papers maintain their folding endurance much better than the untreated paper and, as a result, have a much longer life expectancy. There appears to be little difference in the beneficial effect of the treatment with magnesium methoxide and methyl magnesium carbonate, as both serve to deposit magnesium carbonate in the paper as an alkaline reserve, but the substantial operating advantages of the methyl magnesium carbonate have been amply illustrated in the examples.

I claim as my invention:

1. A composition for the deacidification of paper materials comprising 0.1 to 20% by weight of methyl magnesium carbonate in an organic solvent.

2. The composition of claim 1 wherein the solvent is a volatile solvent, which is not detrimental to paper or inks.

3. A composition according to claim 2 wherein the solvent is methanol.

4. A composition according to calim 3 wherein the methyl magnesium carbonate is present in 1–3% by weight.

5. A composition according to claim 2 wherein the solvent is a halogenated hydrocarbon.

6. A composition according to claim 1 in a spray container with a self-pressurizing halogenated hydrocarbon as said solvent.

* * * * *

UNITED STATES PATENT AND TRADEMARK OFFICE

CERTIFICATE OF CORRECTION

PATENT NO. : 3,939,091

DATED : February 17, 1976

INVENTOR(S) : G. B. Kelly et al.

It is certified that error appears in the above-identified patent and that said Letters Patent are hereby corrected as shown below:

Col. 3, line 1, delete "[Am. Soc., 81, 505-506, (1959)]" and insert in place therefor...[J. Am. Chem. Soc. 85 pp 616-622 (1963)]...

Signed and Sealed this

Fifth Day of April 1977

[SEAL]

*Attest:*

RUTH C. MASON
*Attesting Officer*

C. MARSHALL DANN
*Commissioner of Patents and Trademarks*